US007545088B2

(12) United States Patent
Dean et al.

(10) Patent No.: US 7,545,088 B2
(45) Date of Patent: Jun. 9, 2009

(54) FIELD EMISSION DEVICE

(75) Inventors: Kenneth A. Dean, Phoenix, AZ (US); Bernard F. Coll, Fountain Hills, AZ (US); Emmett M. Howard, Gilbert, AZ (US)

(73) Assignee: Motorola, Inc., Schaumburg, IL (US)

( * ) Notice: Subject to any disclaimer, the term of this patent is extended or adjusted under 35 U.S.C. 154(b) by 417 days.

(21) Appl. No.: 11/345,162

(22) Filed: Jan. 31, 2006

(65) Prior Publication Data

US 2007/0176533 A1 Aug. 2, 2007

(51) Int. Cl.
*H01J 1/02* (2006.01)

(52) U.S. Cl. ..... 313/309; 315/169.1

(58) Field of Classification Search ..... 313/309, 313/495–497; 315/169.1; 445/24–25
See application file for complete search history.

(56) References Cited

U.S. PATENT DOCUMENTS 6,461,211 B1 * 10/2002 Raina et al. ..... 445/24
6,686,680 B2 * 2/2004 Shaw et al. ..... 313/309
2003/0184357 A1 10/2003 Dijon et al.
2004/0056579 A1 * 3/2004 Ha et al. ..... 313/309
2005/0248256 A1 * 11/2005 Song et al. ..... 313/495

OTHER PUBLICATIONS

International Search Report, PCT/US07/60731 dated Feb. 20, 2008.

* cited by examiner

*Primary Examiner*—Nimeshkumar D. Patel
*Assistant Examiner*—Mary Ellen Bowman

(57) ABSTRACT

A field emission device (10) is provided that prevents electrical breakdown. The field emission device (10) comprises an anode (40) distally disposed from a cathode plate that includes an insulating substrate (12) having a portion exposed to the anode (40), and a cathode metal (14) overlying another portion of the insulating substrate (12). A gate electrode (26) overlies an oxide (24) above at least a portion of the cathode metal (14) and optionally above a portion of the substrate. A dielectric layer (18) is positioned between a resistive layer (22) and the cathode metal (14), and substantially all of the exposed substrate, and underlies substantially all of the gate electrode (26) including its edges (34, 46), providing a resistance between the cathode metal (14) and the edges (34, 46).

7 Claims, 2 Drawing Sheets

FIELD EMISSION DEVICE

FIELD OF THE INVENTION

The present invention generally relates to field emission devices and more particularly to a field emission device structure that prevents electrical breakdown.

BACKGROUND OF THE INVENTION

Field emission displays include an anode and a cathode structure. The cathode is configured into a matrix of rows and columns, such that a given pixel can be individually addressed. Addressing is accomplished by placing a positive voltage on one row at a time. During the row activation time, data is sent in parallel to each pixel in the selected row by way of a negative voltage applied to the column connections, while the anode is held at a high positive voltage. The voltage differential between the addressed cathode pixels and the anode accelerates the electrons emitted from the pixels toward the anode.

Field effect devices typically comprise a metal cathode on a substrate, with carbon nanotubes grown on the cathode. A metal catalyst may be positioned between the cathode and the carbon nanotubes for facilitating carbon nanotube growth. A gate electrode is positioned between an anode and the tops of the carbon nanotubes for controlling electron emission from the carbon nanotubes. Electrons flow from the metal cathode through the metal catalyst if present, and out the carbon nanotubes to the anode spaced therefrom.

Color field emission display devices typically include a cathodoluminescent material underlying an electrically conductive anode. The anode resides on an optically transparent frontplate and is positioned in parallel relationship to an electrically conductive cathode. The cathode is typically attached to a glass backplate and a two dimensional array of field emission sites is disposed on the cathode. The anode is divided into a plurality of pixels and each pixel is divided into three subpixels. Each subpixel is formed by a phosphor corresponding to a different one of the three primary colors, for example, red, green, and blue. Correspondingly, the electron emission sites on the cathode are grouped into pixels and subpixels, where each emitter subpixel is aligned with a red, green, or blue subpixel on the anode. By individually activating each subpixel, the resulting color can be varied anywhere within the color gamut triangle. The color gamut triangle is a standardized triangular-shaped chart used in the color display industry. The color gamut triangle is defined by each individual phosphor's color coordinates, and shows the color obtained by activating each primary color to a given output intensity.

However, vacuum field emission devices are commonly plagued with electrons being emitted (a leakage current) from various types of unintended emission sites. These spurious emission sites are often formed as an unintended consequence of the fabrication process. Unintended emitters can result, for example, from anomalously sharp edges of metal electrodes, conductive particles in high field regions, patterning defects, lifting metal, emitters (such as nanotubes) deposited in the wrong place, etc. In addition, many types of field emission cathode structures have a gate electrode stack. This feature typically incorporates a metal gate electrode deposited on top of an insulator, which has been deposited on or very near a cathode electrode.

In the case where the anode field alone is sufficient to initiate electron emission, this undesired emission site is commonly referred to as an anode leader. The intensity of electron emission increases with the applied anode voltage. Furthermore, when field emission devices are in their 'off' state, the gate electrode potential is driven lower than the cathode electrode potential, creating a reverse bias condition. In this case, the cathode electrode itself provides the field which pulls electrons off the gate metal asperity. This emission site is often called a reverse bias leader. Both cases lead to image defects wherein the sub-pixels are always illuminated, resulting in loss of contrast and brightness, and the inability to operate the device at optimal conditions.

Another type of unintended emission results from defects at the edge of the gate electrode stack. Conductive particles can be defects at the base of the gate electrode stack. They might result from particles encountered in the process environment patterning defects re-deposited material during wet processing, or emitter features (such as nanotubes) erroneously deposited in the wrong place. The base of the gate electrode stack forms a junction between a conductor, an insulator, and vacuum which is commonly termed a triple point. This junction creates an enhanced electric field at the conductive defect, and under the influence of the gate potential and/or the anode potential, the conductive defect can emit electrons. These electrons typically cascade up the insulator sidewall, producing an unwanted leakage current between the anode and the cathode, and often produce emitted electrons at the anode. These defects typically are not ballasted by series resistance in the field emission structure so they contribute to excessive (and non-uniform) light at the sub-pixel. They also become hot and produce a run-away current condition that ends in the explosion of the defect, and sometimes a device shorting defect.

Previously known field emission structures, e.g., Spindt tip and some carbon nanotube emitters, often have an unpatterned oxide layer. These structures, comprising metal (cathode)-ballast-oxide-metal (gate), are fabricated by patterning only the top metal layer, leaving an exposed surface of dielectric (oxide). In fact, the manufacturing method of the Spindt tip specifically leaves this dielectric on the surface. This dielectric charges and produces arcs unless a bleed layer is applied to the top surface. To preserve a desired small number of masks, the catalyst or emitter is fabricated with a lift-off process. First, the lift-off photo layer is used as a mask (or to define a lift-off mask) which is used to etch through the oxide layer down to the underlying layers. Next, the emitter or catalyst material is deposited through the same lift-off masking layer into the well and onto the lift-off layer. Removal of the lift-off layer leaves patterned emitter or catalyst in three mask steps. However, the lift-off process does not scale to large size panels. A subtractive etch of the catalyst will be needed. Because these prior art methods use the lift off layer for both local oxide etch (via to bottom metal layer), they need a fourth mask to implement a subtractive etch.

Other methods may comprise a process with only three masks; however, there is a metal (cathode)-ballast-oxide-metal (gate) interface outside the emitter well that is susceptible to small defects resulting in arcs which may short out the device due in part to the ballast providing insufficient vertical resistance for suppressing any arcing. The bottom interface is effectively a metal-oxide-vacuum triple junction which is known to be susceptible to arcing.

Accordingly, it is desirable to provide a field emission device structure that prevents electrical breakdown with as few mask layers as possible. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A field emission device is provided that prevents electrical breakdown. The field emission device comprises an anode distally disposed from a cathode plate that includes an insulating substrate having a portion exposed to the anode, and a cathode metal overlying another portion of the insulating substrate. A gate electrode overlies an oxide above at least a portion of the cathode metal and optionally above a portion of the substrate. A resistive layer overlies the cathode metal and substantially all of the exposed substrate, and underlies substantially all of the gate electrode including its edges, providing a resistance between the cathode metal and the edges.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

In order to eliminate electron emission from residual conductive material on the insulator surface at the edge of the gate metal stack and other defects occurring at the edge of the gate metal stack, of a field emission display, a resistive layer acts as a lateral resistor for arc suppression. The resistive layer may be the same as a ballast layer that is used to couple the electron emitters to the cathode metal. A metal-oxide-ballast-oxide-metal stack is fabricated having the first metal with a sloped sidewall contacting the resistive layer. The first metal-oxide stack is patterned in one step with a slope on both layers, requiring no additional masks. The resistive layer also acts as a bleed layer for charges that accumulate on the cathode surface from operation of the device. Electrons and ions generated from operation of the device tend to collect on the cathode surface. Thus, it is important that either a metal layer or a resistive charge bleed layer cover all non-vertical surfaces of the cathode. Additionally, the resistive layer effectively acts as a spacer landing zone with the ability to bleed charge from the spacer.

Figure 1:
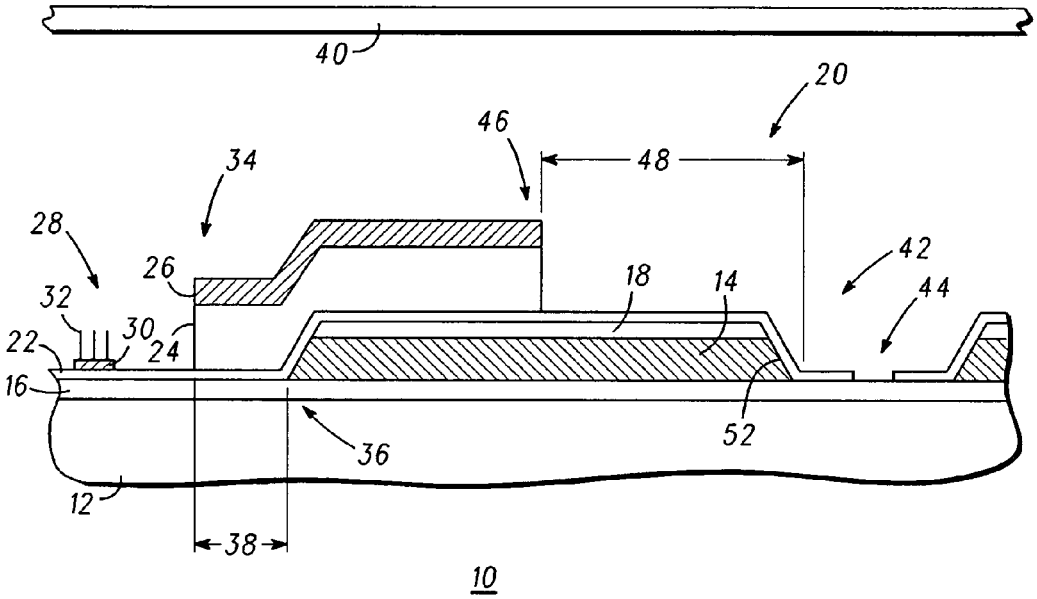
FIG. 1 is a partial cross-section of a field emission device cathode of an exemplary embodiment.
Figure 2:
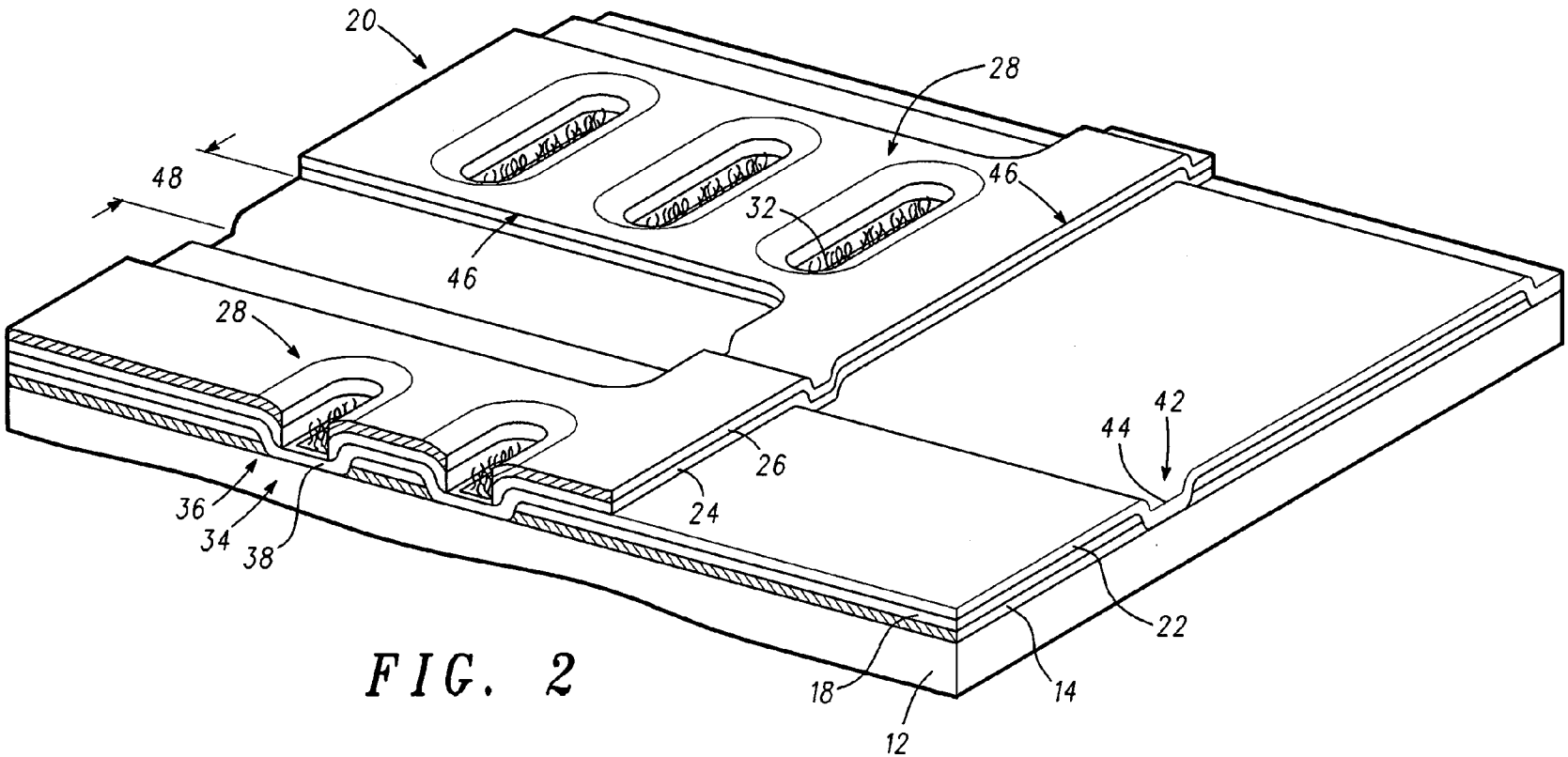
FIG. 2 is a partial perspective view of the exemplary embodiment of FIG. 1.

Referring to FIGS. 1 and 2, a process for forming a cathode 10 in accordance with an exemplary embodiment includes depositing a cathode metal 14 over a substrate 12. The substrate 12 comprises glass; however, alternate materials, for example, silicon, ceramic, metal, a semiconductor material, or an organic material are anticipated by this disclosure. Substrate 12 can include control electronics or other circuitry, which are not shown in this embodiment for simplicity. The cathode metal 14 preferably is molybdenum, but may comprise any metal, or group of conductors such as chrome-copper-chrome layers. An optional buried oxide or dielectric layer 16 may be formed in the top portion of the substrate 12 prior to depositing the cathode metal 14 as a diffusion barrier for contaminants and for providing a pure surface layer. The combination of this buried layer and the substrate is typically considered the 'substrate'. In FIG. 2, the optional buried oxide layer 16 is not shown. A dielectric layer 18 is formed over the cathode metal 14. The dielectric material preferably comprises silicon oxide or silicon nitride, but may comprise any dielectric material including at least silicon dioxide, silicon oxynitride, and a spin-on glass. The thickness of this layer 18 is important. If it is too thin, it may break down at a defect site. If it is too thick, it can change the field applied to the emitters. Typical thickness range from 500 angstroms to 10 micrometers. In the preferred thin film case, the thickness lies between 2000 angstroms and one micrometer. In a thick film device, the preferred thickness for electrical integrity is approximately 4 to 10 micrometers. The cathode metal 14 and dielectric layer 18 are etched using known lithograph processes to form a structure 20.

A ballast resistor layer 22 of a semiconductor material is deposited over the dielectric layer 18 and the substrate 12. A conformal layer (e.g., dielectric layer 24) is deposited over the ballast resistor above the cathode metal 14 to provide spacing for the gate electrode 26. The gate electrode 26 comprises a conductor, for example, molybdenum or chrome-copper-chrome layers. The above layers and materials are formed by standard thin or thick film techniques known in the industry. The combination of the gate metal layer 26, dielectric layer 24, ballast resistor layer 22, dielectric layer 18, and cathode metal 14 may be referred to as a gate electrode stack. The gate electrode 26 and dielectric layer 24 define a well 28.

In accordance with known methods, the optional catalyst layer 30 is deposited on the ballast resistor 22. The catalyst 30 preferably comprises nickel, but could comprise any one of a number of other materials including cobalt, iron, and a transition metal or oxides and alloys thereof. Additionally, the catalyst 30 may be formed by any process known in the industry, e.g., evaporation, sputtering, precipitation, wet chemical impregnation, incipient wetness impregnation, adsorption, ion exchange in aqueous medium or solid state, before having the present invention applied thereto. One preferred method would be to form a relatively smooth film and subsequently etching the film to provide a rougher surface.

In FIG. 1, the exemplary embodiment shows the gate-oxide stack edge 34 closer to the emitter pad 30 than the cathode metal edge 36. Resistive material 22 lies under the gate-oxide stack edge 34 and electrically connects the electron emitter pad 30 to the cathode metal 14. The position of the gate-oxide stack edge 34 relative to the cathode metal edge 36 is important because there is now a resistive path 38 between the gate-oxide stack edge 34 and the cathode metal 36. Any defect that occurs on that edge 34 will not form a point short. In some cases, electron focusing can be improved by moving the gate-oxide stack edge 34 approximately over the top of the cathode metal step edge 36. This is most preferably done with a thick dielectric layer 18 on top of the cathode metal 14, but underlying the resistive layer 22. The ballast 22 at the edge 36 of this dielectric layer 18 then forms a lateral resistance path 38 between the gate-oxide stack edge 34 and the cathode metal 14, offering some protection against leakage currents and spurious electron emission from defects.

Carbon nanotubes 32 are then grown from the catalyst 30 in a manner known to those skilled in the art. Although only a few carbon nanotubes 32 are shown, those skilled in the art understand that any number of carbon nanotubes 32 could be formed. It should be understood that any nanotube or electron emitter having a height to radius ratio of greater than 100, for example, would function equally well with some embodiments of the present invention.

Anode plate 40 includes a solid, transparent material, for example, glass. Typically, a black matrix material (not shown) is disposed on the anode plate to define openings (not shown) representing pixels and sub-pixels containing a phosphor material (not shown) in a manner known to those in the industry. The phosphor material is cathodoluminescent and emits light upon activation by electrons, which are emitted by carbon nanotubes 32.

As used herein, carbon nanotubes include any elongated carbon structure. Preferably, the carbon nanotubes 32 are grown on a line from the catalyst 30 (in this exemplary embodiment) towards the anode 40.

Referring to FIGS. 1 and 2, the side 42 of the cathode metal 14 and dielectric layer 18 opposed to the carbon nanotubes 32 is covered by the ballast resistor 22. The ballast resistor 22 further extends onto and covers part of the buried oxide layer 16 at surface 44. As shown in FIG. 2, the ballast resistor 22 may be continuous. It is this portion of the ballast layer 22 overlying the dielectric layer 18 and the side 42 that acts as a lateral resistor for arc suppression. The resistive layer 22 connects to the underlying cathode metal 14 only at the sides. Consequently, the gate-oxide layer stack edge 46, which sits on the resistive layer 22, is electrically connected to the cathode metal 14 through a large span 48 of the resistive material 22. For effective prevention of spurious emission from defects, the value of this resistance needs to be larger than about 100,000 ohms. For example, this means that a defect that begins to emit one microampere of current under a gate bias of 80 volts, will experience an effective 10 volt drop. This is enough negative feedback to prevent runaway emission. More preferably, the typical resistive path would be larger than one mega-ohm in most regions, so that a small current drops nearly all of the gate voltage in the resistive layer 22, leaving no effective bias on the defect.

It is clearly preferable to have every gate-oxide stack edge 34, 46 separated by a high resistance. However, in practice, the gate metal 26 bus bar must cross the cathode metal edge 42 to proceed to the next pixel. There are several points along the gate oxide stack edge 46 where the resistive path between the gate-oxide stack edge 46 is separated from the cathode electrode 14 by only the thickness of the dielectric layer 18 on top of the cathode metal. At this location, it is often not feasible to provide sufficient resistivity. Obviously, the thicker the dielectric layer is over the cathode metal, the more protection is accomplished at these points in the device. However, the probability of having a defect in that exact location is extremely low, so the overall solution still provides good protection. Clearly, it is desirable to protect a majority of the gate-oxide edges 46 with a highly resistive path. Good protection is obtained when more than 90% of the gate-oxide stack edge 46 length is coupled to the cathode metal 14 through a resistance greater than 100K. More preferably, more than 95% of the gate-oxide stack edge 46S length is coupled to the cathode metal 14 through a resistance greater than 100K.

The exemplary embodiment, incorporating lateral resistances to the cathode metal 14 at predominantly all the gate-oxide stack edges, can be fabricated with only three mask steps. This is an important feature of a low cost field emission device technology. An example of the fabrication sequence is as follows. The cathode metal layer 14 and the dielectric layer 18 are deposited and then patterned using the same mask step (mask 1). They are etched with a sloped sidewall etch technique. The resistive layer 22 is deposited over the top. The oxide layer 24 and the gate layer 26 are deposited on the top and patterned using the same mask step (mask 2) and then etched. Finally, the nanotube catalyst layer 30 (or alternatively the nanotube-containing layer 32) is deposited and patterned using mask step 3. Consequently, the structure can be fabricated with only three mask steps. Alternatively, a fourth low resolution mask might be used to pattern the resistive layer 22 between the cathode metal bus lines 44 (mask 4). In some cases, where the expense of more mask layers can be tolerated, variations to this embodiment may exist. For example, although the dielectric layer 18 extends to the right edge of the cathode metal 14 and the ballast layer 22 extends over the dielectric layer 18 and the cathode metal 14, the dielectric layer 18 and ballast layer 22 may optionally only extend over part of the cathode metal 14.

Another benefit of this structure is that it allows laser repair of structures. In previously known devices, the act of laser repair generates unwanted metal fragments as a laser is used to evaporate metal to excise defective areas. The structure 10 described in this invention prevents such defects from causing point shorts, thereby enabling laser repair.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

The invention claimed is:

1. A field emission device comprising:

an anode plate including an anode having a first surface; and a cathode plate distally disposed from the first surface and having sequential first, second, third, fourth, and fifth portions, comprising:

a substrate positioned in the first, second, third, fourth, and fifth portions;

a cathode metal overlying the third and fourth portion of the substrate;

a first dielectric layer overlying the cathode metal, the cathode metal and first dielectric layer forming a first side adjacent the second portion and a second side adjacent the fifth portion;

a plurality of electron emitters consisting of being positioned over the substrate in the first portion;

a ballast resistive layer formed on the first dielectric layer in the third and fourth portions, formed on the substrate in the first, second, and fifth portions, and covering the first and second sides, thereby making electrical contact between the cathode metal and the plurality of electron emitters, and providing a surface exposed to the anode in the fifth portion;

a second dielectric layer overlying the ballast resistive layer surface in the second and third portions; and a gate metal layer overlying the second dielectric layer, the second dielectric layer and the gate metal layer having a third side adjacent the first portion and defining a well enclosing the plurality of electron emitters and a fourth side adjacent the fourth portion, the third side distally disposed from the first side and the fourth side distally disposed from the second side, wherein the ballast resistive layer provides a resistance between the fourth side of the gate metal and the cathode metal.

2. The field emission device of claim 1 wherein the first side is between the second and third portions, the second side is on a side of the fourth portion opposed to the third portion, the third side is between the first and second portions, and the fourth side is between the second and third portions.

3. The field emission device of claim 1 wherein the resistance of the ballast layer between the first and third sides is greater than 100,000 ohms.

4. The field emission device of claim 1 wherein the resistance of the ballast layer between the first and third sides is greater than one mega-ohm.

5. The field emission device of claim 1 wherein the resistance of the ballast layer between the second and fourth sides is greater than 100,000 ohms.

6. The field emission device of claim 1 wherein the resistance of the ballast layer between the second and fourth sides is greater than one mega-ohm.

7. The field emission device of claim 1 further comprising a spacer positioned between the anode and the ballast layer that overlies the cathode metal.

* * * * *